US005845989A

United States Patent [19]

Leen

[11] Patent Number: 5,845,989

[45] Date of Patent: Dec. 8, 1998

[54] INTEGRAL SPARE BULB CONTAINER FOR HALOGEN WORK LIGHT

[76] Inventor: Monte A. Leen, 1804 W. Lake Sammamish Pkwy. NE., Bellevue, Wash. 98008

[21] Appl. No.: 815,303

[22] Filed: Mar. 11, 1997

[51] Int. Cl.[6] ..... F21S 1/12

[52] U.S. Cl. ..... 362/410; 362/374; 362/375; 362/376; 206/418

[58] Field of Search ..... 362/410, 207, 362/263, 457, 458, 376, 184, 374, 375; 206/418, 419

[56] References Cited

U.S. PATENT DOCUMENTS

| | | | |
|---|---|---|---|
| 4,110,820 | 8/1978 | Konoshima | 362/207 |
| 4,388,673 | 6/1983 | Maglica | 362/183 |
| 4,819,141 | 4/1989 | Maglica et al. | 362/207 |
| 5,307,255 | 4/1994 | Chen | 362/410 |
| 5,349,506 | 9/1994 | Maglica | 362/207 X |
| 5,408,399 | 4/1995 | Atkins et al. | 362/376 |
| 5,432,689 | 7/1995 | Sharrah et al. | 362/205 X |
| 5,455,756 | 10/1995 | Sumer et al. | 362/376 |
| 5,483,429 | 1/1996 | Chu | 362/207 X |
| 5,515,971 | 5/1996 | Segrest | 206/418 |
| 5,601,359 | 2/1997 | Sharrah et al. | 362/207 X |
| 5,695,278 | 12/1997 | Grossman et al. | 362/374 |

FOREIGN PATENT DOCUMENTS

| | | | |
|---|---|---|---|
| 339729 | 7/1930 | United Kingdom | 362/207 |

*Primary Examiner*—Ira S. Lazarus
*Assistant Examiner*—David Lee
*Attorney, Agent, or Firm*—Christensen O'Connor Johnson & Kindness PLLC

[57] ABSTRACT

A halogen work light (11) with an integral spare bulb container (31) is disclosed. The spare bulb container (31) is attached to the support frame (15) of the halogen work light (11) by welding, for example. The spare bulb container includes a tubular housing (33) and a pair of end pieces (35) that friction fit into the ends of the housing (33). The end pieces include longitudinal holes (43) for receiving the ends of a halogen bulb (45). The end pieces are formed of a soft, resilient material, such as rubber.

2 Claims, 3 Drawing Sheets

INTEGRAL SPARE BULB CONTAINER FOR HALOGEN WORK LIGHT

FIELD OF THE INVENTION

This invention relates to work lights and, more particularly, to halogen work lights.

BACKGROUND OF THE INVENTION

In recent years, a variety of types of high- and low-profile halogen work lights have been developed. High-profile halogen work lights include halogen lamps located in U-shaped brackets mounted on tripods and other elevation-raising mechanisms. Low-profile halogen work lights include halogen lamps supported by frames formed of metal having a variety of shapes. Some low-profile halogen work lights combine halogen lamps with other elements, such as AC outlets, reels for extension cords, etc. The frames of low-profile halogen work lights include sections bent to lie in a common plane that defines a base or sections welded together to create feet. The base or feet are designed to be positioned atop a floor or other generally horizontal support surface. In addition to a base or feet, the frames include sections or U-shaped brackets for supporting a halogen lamp. An elevation control and locking mechanism that allows the beam of the halogen lamp to be elevated to a desired position and clamped is also usually included in both high- and low-profile halogen work lights.

In the past, one of the major disadvantages of halogen work lights has been the lack of a readily accessible spare halogen bulb for installation when a bulb in the work light burns out. In the past, spare bulbs have been stored in work boxes, work vehicles, and the like. In such locations spare bulbs are often not readily available. Further, they are subject to damage.

As a result, a need exists for a spare bulb container that is readily accessible when the bulb of a work light burns out that also prevents the spare bulb from being easily damaged. The present invention is directed to fulfilling this need.

SUMMARY OF THE INVENTION

In accordance with this invention, a spare bulb container for halogen work lights that is integral with the work light is provided. The spare bulb container is elongate and includes soft end pieces that include integral apertures sized to receive the ends of an elongate halogen bulb.

In accordance with other aspects of this invention, the spare bulb container is tubular.

In accordance with further aspects of this invention, the end pieces are formed of rubber and are held in the ends of the tubular container by friction.

In accordance with still other aspects of this invention, the spare bulb container includes a tubular body formed of metal.

In accordance with still further aspects of this invention, the tubular body is welded to the frame of the halogen work light.

As will be readily appreciated from the foregoing description, the present invention provides a spare bulb container for a halogen work light that remains with the work light as it is moved from position to position. Thus, the spare bulb in the container is always readily available. Further, the spare bulb container is designed to avoid damage to the bulb due to the shock and vibration that often occurs when work lights are moved and used.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
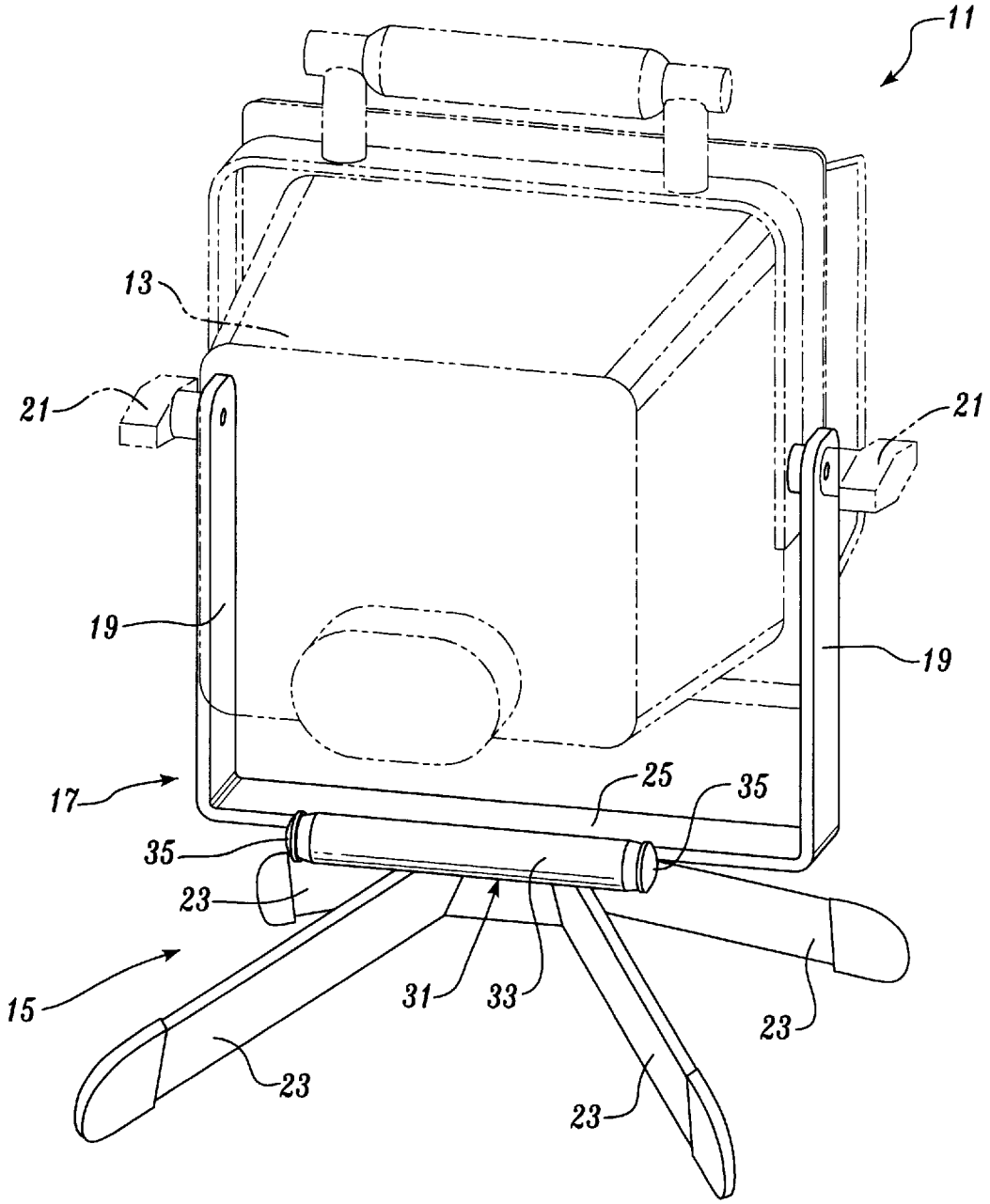
FIG. 1 is an isometric view of an embodiment of the invention incorporated in one type of halogen work light.

FIG. 1 illustrates a halogen work light 11 incorporating the invention. The halogen work light 11 includes a halogen lamp 13, shown in phantom, that includes an open-sided housing formed of metal, such as aluminum. As well known to those familiar with halogen work lights, the halogen lamp 13 also includes a reflector mounted in the housing and an elongate halogen bulb. The opening in the housing is enclosed by a glass lens that is held in place by a frame. The frame supports a protective grill formed either of a plurality of thin wires welded together, or cast as a single unit with the frame. The grill provides a protective shield in front of the glass lens. For a more detailed description of a halogen lamp of the type shown in FIG. 1, attention is directed to U.S. patent application Ser. No. 08/728,660, filed Oct. 10, 1996, the subject matter of which is incorporated herein by reference.

The halogen work light 11 shown in FIG. 1 also includes a support frame 15. The support frame 15 includes a U-shaped section 17. The halogen lamp 13 is mounted between the legs 19 of the U-shaped section 17. More specifically, an attachment mechanism in the form of lock bolts 21 having T-shaped outer ends pass through holes in the upper end of the legs 19. The lock bulbs are threaded into holes in the sides of the housing of the halogen lamp 13. Attention is directed to U.S. patent application Ser. No. 08/728,660, referenced more fully above, and incorporated herein by reference, for a more detailed description of this attachment mechanism.

The frame 15 also includes four legs 23 that are affixed to and extend downwardly and outwardly from the center region of the bottom of the cross-member 25 of the U-shaped section 17. Preferably, the U-shaped section 17 and the legs are formed of iron, and the legs 29 are welded to the cross-member 25.

Figure 3:
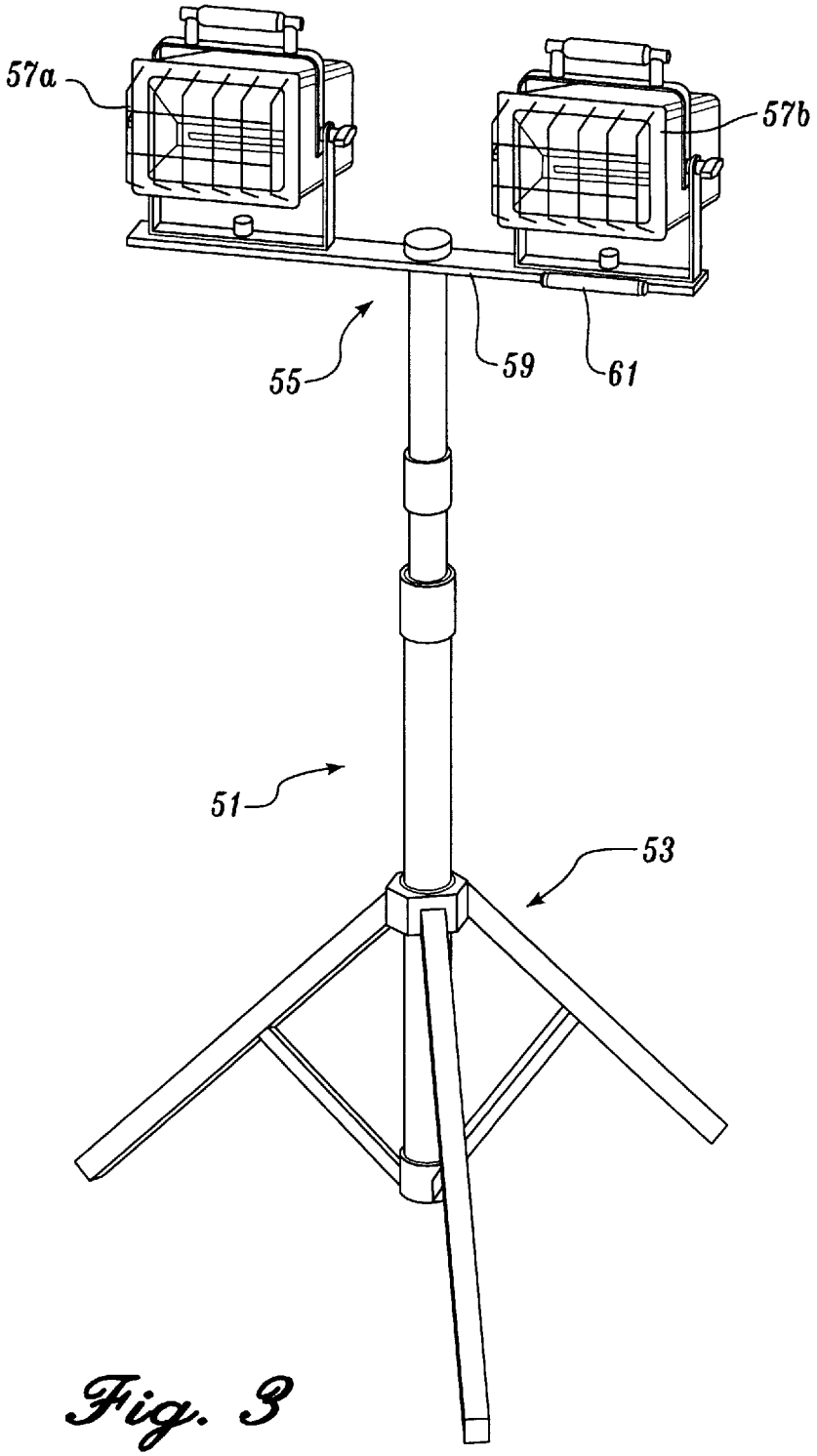
FIG. 3 is an isometric view of the invention incorporated into another type of halogen work light.

As will be better understood from the following description, the present invention is not specifically directed to halogen work lights of the type shown in FIG. 1. That is, the work light shown in FIG. 1 should be taken as exemplary, not limiting. Further, in addition to finding use with a wide variety of low-profile work lights, including the type shown in FIG. 1, the invention can also be used with high-profile work lights, i.e., work lights mounted on tripods and other elevation-raising mechanisms, as shown in FIG. 3 and described below.

The present invention is directed to a spare bulb container 31 that is integral with a halogen work light. In the exemplary halogen work light shown in FIG. 1, the spare bulb container 31 is affixed to the cross-member 25 of the U-shaped section 17 of the frame 15.

Figure 2:
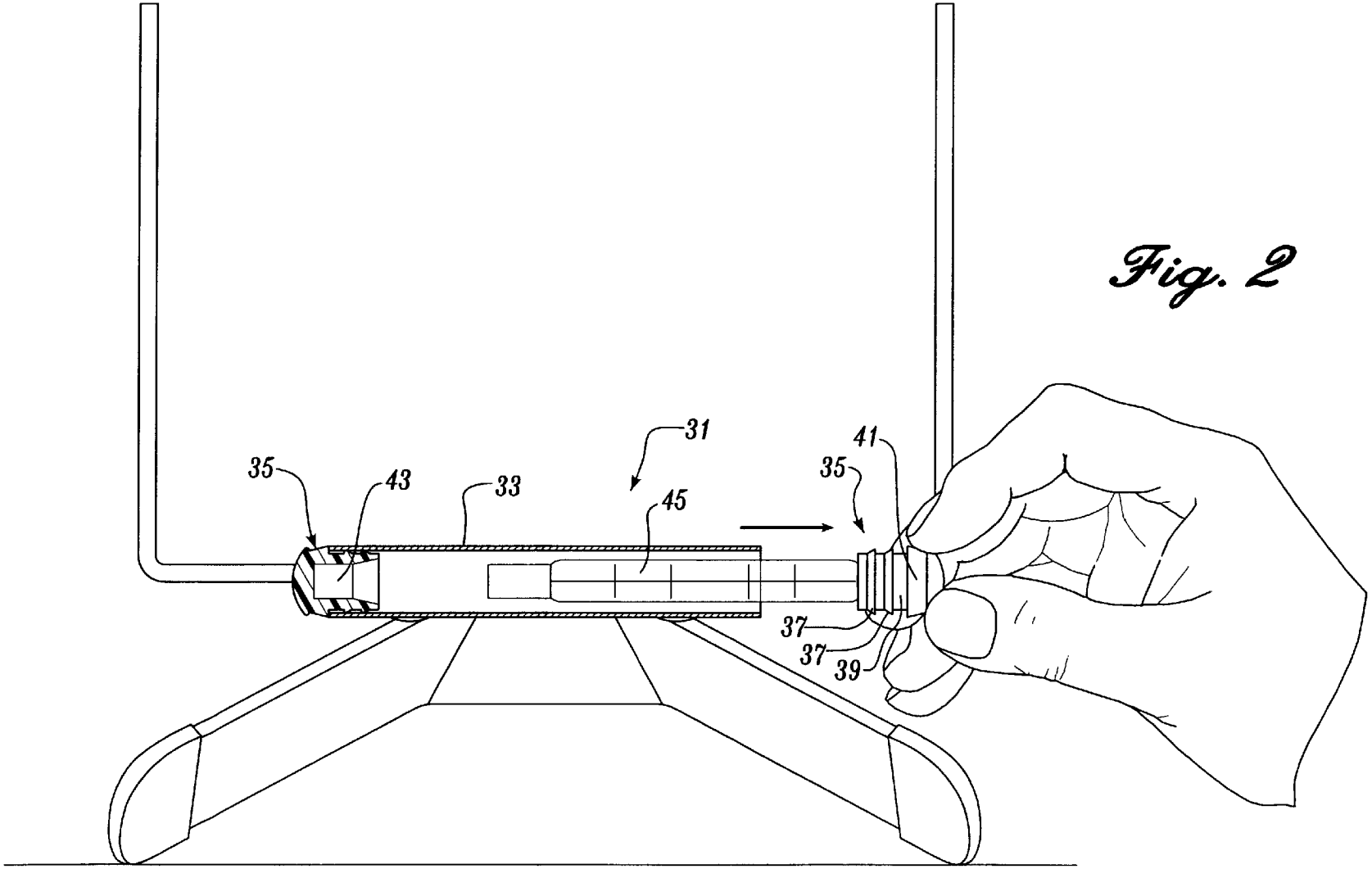
FIG 2 is a cross-sectional exploded view of the embodiment of the invention shown in FIG. 1.

As shown best in FIG. 2, the spare bulb container 31 includes a stiff tubular housing 33 and a pair of end pieces 35. The tubular housing is affixed to the cross-member 25. Preferably, the tubular housing 33 is formed of iron and is affixed to the cross-member 25 by welding.

The end pieces 35 are formed of a relatively soft material, such as rubber, and sized to friction fit into the ends of the tubular housing 33. More specifically, the end pieces have an outer periphery that matches the shape of the ends of the tubular housing 33. If the tubular housing is cylindrical, as shown in the drawings, the end pieces are generally cylindrical in shape. Preferably, the end pieces 35 include one or more peripheral teeth 37 surrounding a cylindrical body 39. The teeth 37 taper toward the tubular housing 33. Preferably, the outer diameter of the teeth 37 is slightly greater than the inner diameter of the tubular housing and the diameter of the cylindrical body 39 is slightly less than the inner diameter of the tubular housing, as best seen on the left side of FIG. 2. As a result, the peripheral teeth 37 slightly compress when the end pieces are located in the ends of the tubular housing 33, resulting in a friction fit. The outer ends 41 of the end pieces 35 are enlarged to limit the amount that the end pieces can be slid into the ends of the tubular housing 33.

The end pieces 35 include central longitudinal holes 43 sized to receive the ends of a spare halogen bulb 45. More specifically, the ends of the end pieces 35 surrounded by the teeth include the central longitudinal holes 43. When the end pieces are installed correctly in the tubular housing 33, the holes 43 face one another.

The length of the tubular housing 33 is such that when the end pieces are installed, the distance between the holes is such that the ends of a spare halogen bulb 45 positioned in the tubular housing 33 are gripped by the holes in the end pieces. Because the end pieces are soft, being formed of rubber or a similarly resilient material, the end pieces form a shock-absorbing support for the spare bulb.

As noted above, while the illustrated embodiment of the invention has been shown combined with a particular low-profile halogen work light, it is to be understood that the invention can be used with other types of low-profile halogen work lights, as well as with high-profile halogen work lights. In this regard, attention is directed to FIG. 3, which shows a high-profile work light 51 that includes a telescoping tripod stand 53 and a bracket 55 that supports a pair of halogen lamps 57*a* and 57*b*. More specifically, the halogen lamps 57*a* and 57*b* are located at the opposite ends of a horizontal bar 59 that forms part of the bracket 55. Affixed to the horizontal bar 59 is a spare bulb container 61 similar to the spare bulb container 31 shown in FIGS. 1 and 2 and described above.

In addition to being incorporated into a variety of different types of work lights, rather than being welded to the frame of the work light, spare bulb containers formed in accordance with the invention can be attached in other manners, such as mechanically (bolts and nuts, rivets, etc.) or with a suitable adhesion. Also, rather than being cylindrical, the tubular container can have other cross-sectional shapes, e.g., square, triangular, hexagonal, etc. Obviously, the cross-sectional shape of the end pieces must be changed to match the chosen cross-sectional shape of the tubular container. Consequently, within the scope of the appended claims, it is to be understood that the invention can be practiced otherwise than as specifically described herein.

The embodiments of the invention in which an exclusive property or privilege is claimed are defined as follows:

1. In a halogen work light comprising a halogen lamp including an elongate halogen bulb mounted in a housing and a support frame for supporting the halogen lamp, the improvement comprising an elongate spare bulb container affixed to an exterior surface of the supporting frame of said halogen work light, said elongate spare bulb container including a tubular housing open at both ends and two end pieces, one end piece mounted in each end of said tubular housing, each of said end pieces including an integral cavity for receiving an end of an elongate halogen bulb.

2. The improvement claimed in claim 1, wherein said support frame and said tubular housing are both formed of a weldable material and wherein said tubular housing is affixed to said support frame by welding.

* * * * *